US006007103A

United States Patent [19]

Tomasello

[11] Patent Number: 6,007,103

[45] Date of Patent: Dec. 28, 1999

[54] BINDER ACCESSORY

[76] Inventor: Shirley J. Tomasello, W2906 N535Blodwen Dr., Waukesha, (Delafield Town), Wis. 53188

[21] Appl. No.: 09/055,384

[22] Filed: Apr. 6, 1998

[51] Int. Cl.[6] ..... B42D 3/00

[52] U.S. Cl. ..... 281/28; 281/24; 281/32; 281/34; 281/51; 281/43

[58] Field of Search ..... 281/51, 43, 24, 281/28, 32, 34

[56] References Cited

U.S. PATENT DOCUMENTS

| | | | |
|---|---|---|---|
| 4,569,613 | 2/1986 | Thomas | 402/80 |
| 4,886,390 | 12/1989 | Silence et al. | 402/80 R |
| 5,332,264 | 7/1994 | Chiarella | 281/51 |

*Primary Examiner*—Willmon Fridie, Jr.
*Assistant Examiner*—Mark T. Henderson
*Attorney, Agent, or Firm*—Willis B. Swartwout, III

[57] ABSTRACT

A pull tab accessory device for any type of binder but most particularly for a ring binder having multiple rings such as the commonly known "three ring binder". In one embodiment the tab may be an extension of the spine of a book or binder elongated as desired and tapered to form a surface which may be readily grasped by the thumb and fingers of a person. The extension is pliable and deformable to form an angle of ninety degrees with the spine if required. A second embodiment is an elongated flexible member having one or more legs provided with an aperture at one end and with a tab suitable for grasping by the thumb and fingers of a person at the end remote from the aperture. The aperture is shaped in cross-sectional dimension to slide over the lowermost ring of a ring binder.

4 Claims, 2 Drawing Sheets

BINDER ACCESSORY

BACKGROUND OF THE INVENTION

The present invention relates to binders for containing pages. The invention can serve to assist with any kind of binder such as a book or the like but has particular application to a ring binder and even more particularly to a three ring binder.

One of the difficulties in shelving binders, especially of the three ring variety is in selecting one from a group on a shelf. Part of the problem is in the fact the binders tend to be wedge shaped and therefore do not store well on a shelf. Prior art patents have been granted which result in getting the binder covers to spread into a more rectangular solid. This however makes the extraction of one from the group more difficult especially without disturbing the shelving arrangement.

SUMMARY OF THE INVENTION

The present invention proposes to provide a binder with a shelf extraction aid which is attached to the binder and allowed to extend therefrom to the rear to aid in removing the selected binder from a shelf.

It is an object of the present invention to provide a binder having a front and back cover and a binder spine wherein the binder is provided with an extraction aid for removing the binder from a shelved grouping of binders.

It is another object of the present invention to provide the invention of the character above described wherein the extraction aid is secured to the spine by tying, molding or adhesively joining the extraction aid to the binder spine.

It is still another object of the present invention to provide in a device of the character above described an elongated spine having an extended tab section at one end for use as an extraction aid.

It is yet a further object of the present invention to provide a device of the character above described wherein said extended spine section is deformable.

The foregoing and other objects and advantages of the invention will appear from the following description. In the description reference is made to the accompanying drawings which form a part hereof, and in which there is shown by way of illustration a preferred embodiment of the invention. Such embodiment does not necessarily represent the full scope of the invention, however, and reference is made to the claims herein for interpreting the scope of the invention.

DESCRIPTION OF THE PREFERRED EMBODIMENTS

Figure 1:
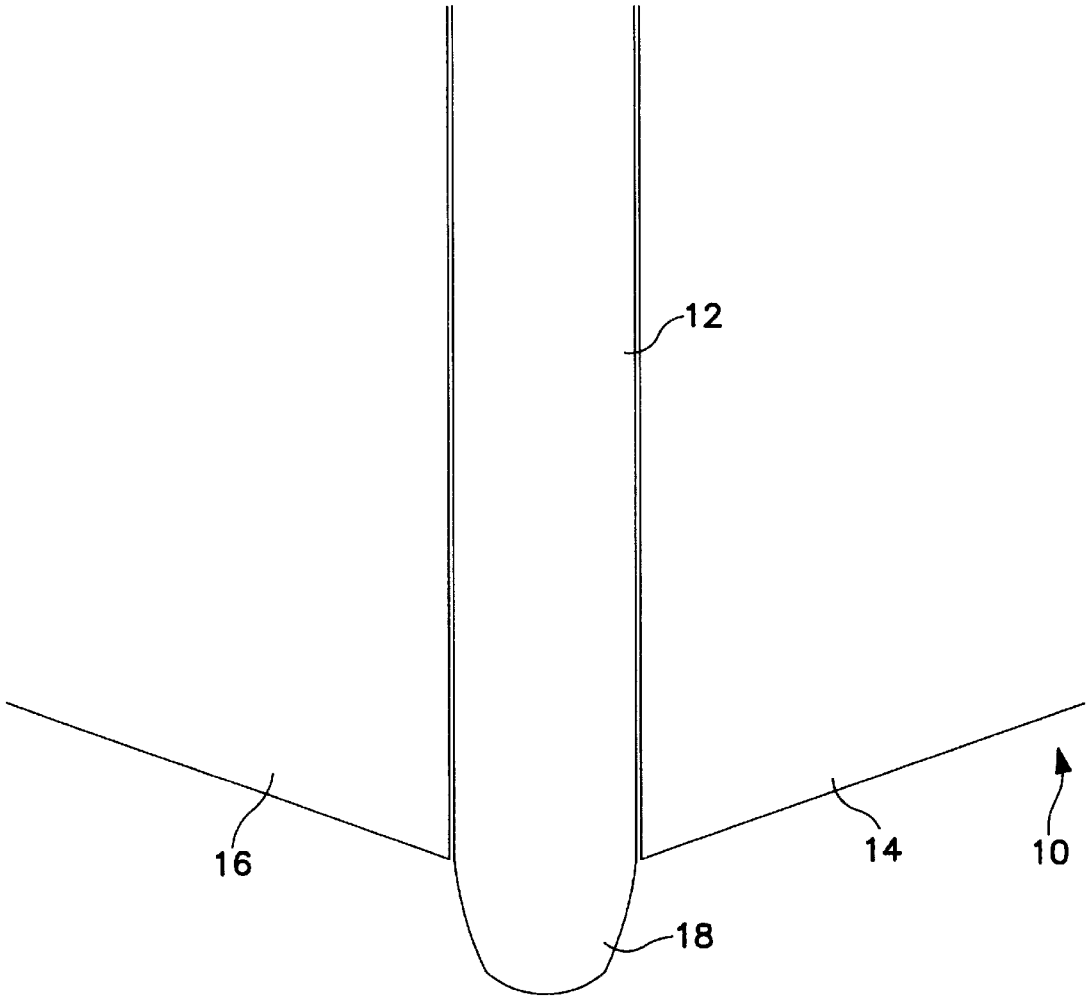
FIG. 1 is a vertical plan view of the exterior of a binder showing one embodiment of the present invention.
Figure 2:
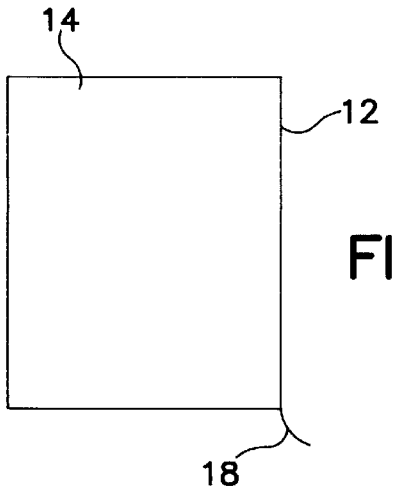
FIG. 2 is a smaller side view of the structure shown in FIG. 1.

Referring now to the drawings and in particular to FIGS. 1 and 2 thereof a binder is shown generally identified by the numeral 10. Binder 10 is provided with an elongated spine 12, an elongated front cover 14 and an elongated back cover

16 each attached to one elongated side of spine 12 and adapted for pivotal movement relative to spine 12 through an arc of approximately 180 degrees. Note that spine 12 is provided at one end with an elongated and tapering spine extension 18 molded or constructed as a part of spine 12 and the spine extension 18 is flexible rather than rigid like the remainder of spine 12. Thus when a binder 10 is shelved in the upright position extension 18 sticks out backwardly relative to binder 10 such that the binder may be easily selected from a number of shelved binders and pulled manually from the shelf.

Figure 3:
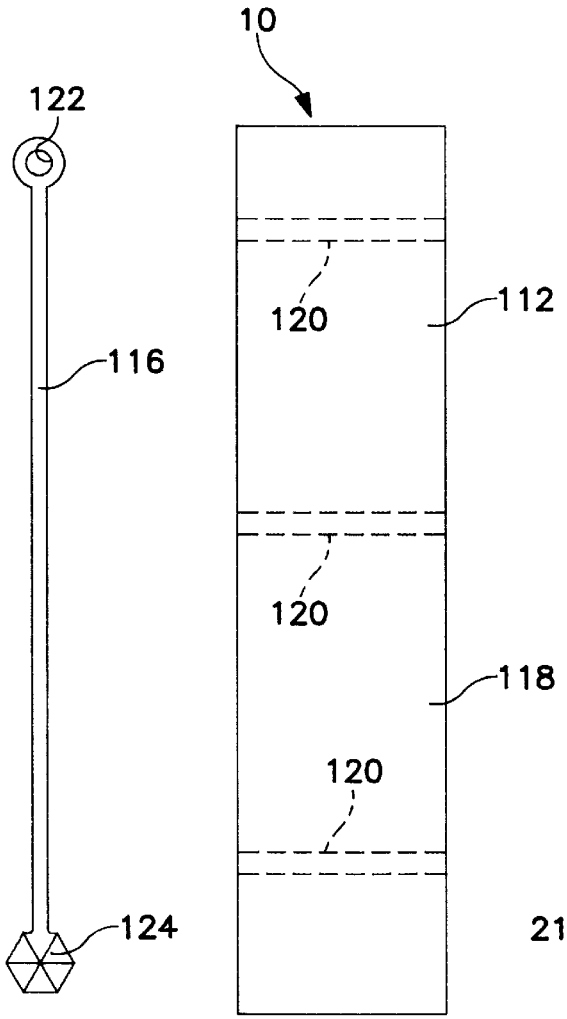
FIG. 3 is a vertical plan view of a second embodiment of the present invention with ring structure shown in dotted line.

A second embodiment of the present invention is shown in FIG. 3 and similar structure is identified by similar numerals in the one hundred series. In this embodiment spine 112 has an exterior surface 118 and an interior surface (not shown) relative to a common binder 10. Note that in this embodiment the spine 112 does not have an elongated and tapering spine extension such as in the first embodiment. This is because the second embodiment is designed to work in conjunction with various binders 10 which have a plurality of internal rings 120 for holding paper or the like (not shown). The most common form of such binder 10 is a "three ring binder" many of which are in use today. While this disclosure pays particular reference to the "three ring binder" it should be noted that the invention can be practiced by any multiple ring binder from two to infinity. An elongated pull 116 replaces the tapered spine extension of the first embodiment. Pull 116 is elongated and has a generally circular aperture 122 at one end and a pull tab 124 at the end of pull 116 remote from aperture 122. Although this limitation is not a part of the claims hereunto annexed the pull is made from a flexible substance such as NYLON or plastic designed to withstand at least twenty-five pounds of pulling pressure without stretching, deforming or breaking. Pull 116 may be of any desired and appropriate length. The aperture 122 is designed to fit over the only or bottom most ring 120 of the multiple ring binder.

Figure 4:
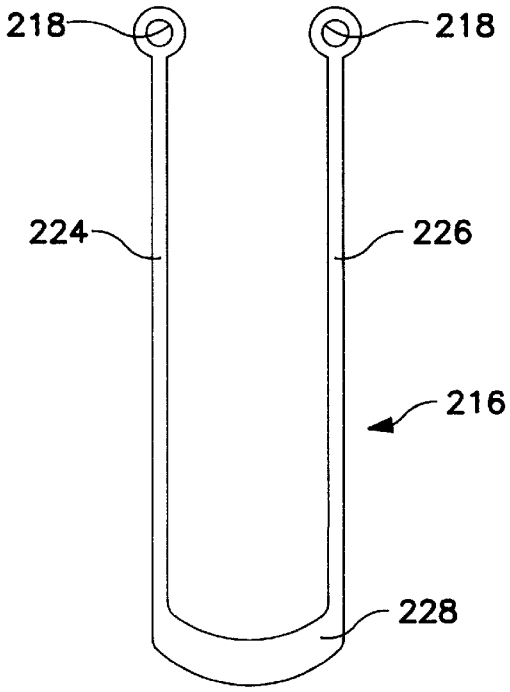
FIG. 4 is a vertical plan view similar to FIG. 3 showing a third embodiment of the present invention.

A third embodiment of the present invention is shown in FIG. 4 of the drawings and similar structure is identified by similar numbers in the two hundred series. In this embodiment the pull 216 is U-shaped in vertical plan with elongated legs 224 and 226 extending at one end of each in generally parallel fashion from the closed end 228 of the U-shape, terminating in an aperture 218 remote from said closed end of the U-shape. Note that the closed end 228 of pull 216 is of increased lateral dimension to give strength to pull 216 and to act as a pull tab. The apertures 218 are designed to fit over the only or bottom most ring 120 of a binder. The overall length of pull 216 is such as may be convenient and pull 216 is preferably made from pliable NYLON or plastic designed to withstand at least twenty-five pounds of pulling pressure without stretching, deforming or breaking.

It can now be seen that the structure of the present invention as shown in the disclosure and various embodiments carries out the objects and advantages of the invention as previously set forth herein and as will be covered in the scope of the annexed claims.

I claim:

1. A shelf extraction aid for a binder having at least one ring for holding insertable material comprising:

a) an elongated flexible member b) one end of said member being provided with at least one aperture designed to fit over said ring; and c) the end of said member remote from said aperture provided with a tab adapted for grasping by thumb and fingers of a person.

2. The structure as set forth in claim 1, wherein said aperture is shaped in cross-sectional dimension to slide over the ring of said binder.

3. The structure as set forth in claim 2, wherein said elongated flexible member is generally U-shaped in vertical plan view;

a) said member provided with a closed end having two flexible legs, b) each said leg having an aperture at the end thereof remote from said closed end of said U-shaped member shaped in cross-sectional dimension complementarily to the cross-sectional shape of the ring and wherein said closed end of said U-shaped member is flattened to serve as a tab for grasping by the thumbs and fingers of a person.

4. The structure as set forth in claim 3, wherein said binder has multiple, vertically spaced rings and said legs are generally spaced, parallel and co-extensive in length and said apertures are shaped in cross-sectional dimension to slideably fit over the lowermost ring of said binder.

* * * * *